US007540117B2

(12) United States Patent
Yang

(10) Patent No.: US 7,540,117 B2
(45) Date of Patent: Jun. 2, 2009

(54) VIBRATION ISOLATION SYSTEM FOR BUILDING

(76) Inventor: Hong Yang, 901 13#, Hong Xiang Bei Yi Street, Cai Hong Road, Foshan City, Guangdong Province (CN) 528000

( * ) Notice: Subject to any disclaimer, the term of this patent is extended or adjusted under 35 U.S.C. 154(b) by 853 days.

(21) Appl. No.: 10/522,765

(22) PCT Filed: Aug. 4, 2003

(86) PCT No.: PCT/CN03/00624

§ 371 (c)(1),
(2), (4) Date: Feb. 1, 2005

(87) PCT Pub. No.: WO2004/013428

PCT Pub. Date: Feb. 12, 2004

(65) Prior Publication Data

US 2006/0005477 A1 Jan. 12, 2006

(30) Foreign Application Priority Data

Aug. 6, 2002 (CN) ..... 02 1 34520

(51) Int. Cl.
*E04B 1/98* (2006.01)

(52) U.S. Cl. ..... 52/167.4; 52/167.7; 52/167.1

(58) Field of Classification Search ..... 52/167.1, 52/167.3–167.9; 248/638
See application file for complete search history.

(56) References Cited

U.S. PATENT DOCUMENTS 3,638,377 A * 2/1972 Caspe ..... 52/167.4
3,730,463 A * 5/1973 Richard ..... 248/580
4,574,540 A * 3/1986 Shiau ..... 52/167.8
4,599,834 A * 7/1986 Fujimoto et al. ..... 52/167.8

(Continued)

FOREIGN PATENT DOCUMENTS

CN 1196432 A 10/1998

(Continued)

OTHER PUBLICATIONS

Hisaiti Taketa, "Earthquake Isolation, Vibration-prevention, Vibration-Control for Building," relevant portion citing JP Patent No. 61135, english translation enclosed (1924).

*Primary Examiner*—Richard E Chilcot, Jr.
*Assistant Examiner*—Elizabeth A Plummer
(74) *Attorney, Agent, or Firm*—Perkins Coie LLP; Manni Li

(57) ABSTRACT

A vibration isolation system for building, comprising a vibration isolation layer, the vibration isolation layer including: an upper layer structure consisted of upper beams and/or slabs and moveable bases, which is coupled to columns of the building; a lower layer structure consisted of lower beams and/or slabs and fixed bases; and vibration isolation devices and elastic member horizon-resetting devices which are mounted between the upper layer structure and the lower layer structure, in which the vibration isolation devices are mounted between the moveable bases and the fixed bases, respectively, and the elastic member horizon-resetting devices are mounted between the beams and/or slabs of the upper layer structure and the lower layer structure, respectively. Therefore, the above devices do not interfere with each other and convenient to maintain, and positions and functional parameters thereof can be set and selected reasonably.

8 Claims, 7 Drawing Sheets

U.S. PATENT DOCUMENTS 4,883,250 A * 11/1989 Yano et al. ..... 248/638
5,970,666 A * 10/1999 Kurabayashi et al. ..... 52/167.6
6,085,471 A 7/2000 Axon ..... 52/167

FOREIGN PATENT DOCUMENTS

JP 60211142 A * 10/1985
JP 61049028 A * 3/1986
JP 11-303925 11/1999
JP 2000104420 A 4/2000
JP 2000186743 A * 7/2000
JP 2001241009 A 9/2001

* cited by examiner

A — A

B — B

VIBRATION ISOLATION SYSTEM FOR BUILDING

TECHNICAL FIELD

The present invention relates to a vibration isolation system for building, the vibration isolation system of the present invention is also applicable to constructing structures, bridges, and other objects required to be vibration-isolated.

BACKGROUND ART

In order to isolate a building from vibration, a vibration isolation system for building should satisfy the following requirements:

1. allowing flexible sliding movements between the building and a bases;

2. having enough large initial rigidity;

3. having enough ability of damping and energy dissipation so as to limit the displacement of the building;

4. having functions of resetting the building.

The existing vibration isolation system for building is formed such that vibration isolation devices (rolling bearing vibration isolation devices or sliding bearing vibration isolation devices), elastic member horizon-resetting devices (rubber block or sandwiched rubber block horizon-resetting devices), damping and energy dissipation devices and so on are provided between movable bases and fixed bases which are positioned at the bottom of columns of the building. The rolling (or rollers sandwiched between sliding plates) bearing vibration isolation devices bear the vertical load of the building; the elastic member horizon-resetting devices and the damping and energy dissipation devices are generally positioned around the rolling bearing vibration isolation devices, wherein the elastic member horizon-resetting devices are used to reset the position of the building and the damping and energy dissipation devices are used to provide enough initial rigidity and energy dissipation ability so as to limit the relative displacement of the building to the base.

The Japanese Patent Publication No. 61135 filed in 1924 and issued to KITO KENZABURO disclosed a vibration isolation device using rolling bearing, in which roll balls are sandwiched between utensil type disks which are provided on opposite concave surfaces formed between the base and the bottom of the columns, so as to support the building. However, the above vibration isolation device has a low load carrying capacity, is high in cost, and thus the use range thereof is limited.

The various devices of the above vibration isolation system are all provided on the vibration isolation layer of the building, the vibration isolation layer comprises an upper layer structure, a lower layer structure and various devices of the vibration isolation system which are mounted between the upper and the lower layer structures, the upper layer structure is consisted of upper beams and/or slabs and movable bases, and the lower layer structure is consisted of lower beams and/or slabs and fixed bases. More specifically, the rolling bearing vibration isolation devices, the rubber block horizon-resetting devices and the like are all arranged between the moveable bases and the fixed bases. The above various devices carry out their functions respectively and separately. Since the spaces under the bottom of the columns of the building are limited, the values of the function parameters of the various devices to be selected are interfered with one another and difficult to set reasonably. In addition, the various devices are difficult to maintain. These are the main reasons why the above vibration isolation technique is not put into use practically until now.

SUMMARY OF THE INVENTION

In view of the foregoing problems, an object of the present invention is to provide a vibration isolation system for building, which not only meets the requirements of vibration isolation for building but also is less limited by the structure at the bottom of the columns of the building, so that the function parameters and positions of various devices of the vibration isolation system can be set and designed reasonably, and the various devices are convenient to be maintained and exchanged.

In order to achieve the above object, there is provided a vibration isolation system for building, comprising a vibration isolation layer which includes an upper layer structure, a lower layer structure, and various devices of the vibration isolation system which are provided between the upper layer structure and the lower layer structure, the upper layer structure is consisted of upper beams and/or slabs and moveable bases, and the lower layer structure is consisted of lower beams and/or slabs and fixed bases, the various devices include vibration isolation devices and elastic member horizon-resetting devices, the upper layer structure (i.e. the structural members constituting the upper layer structure) is coupled to the columns of the building, in which the vibration isolation devices are mounted between the moveable bases and the fixed bases, and the elastic member horizon-resetting devices are mounted between the upper layer structure and the lower layer structure, respectively.

Preferably, each elastic member horizon-resetting device is formed such that an upper hole is provided in the upper beam and/or slab of the upper layer structure, and a lower hole corresponding to the upper hole is provided in the lower layer structure, the upper hole and the lower hole are filled with filling material, and an elastic member having an upper coupling plate and a lower coupling plate is mounted between the filling material filled in the corresponding upper and lower holes respectively.

The vibration isolation system of the present invention has the following advantages: in the vibration isolation system of the present invention, since the vibration isolation devices (rolling bearing vibration isolation devices or sliding bearing vibration isolation devices) are mounted between the movable bases and the fixed bases, the elastic member horizon-resetting devices (rubber or sandwiched rubber block horizon-resetting devices) are provided between the slabs of the upper and lower layer structures of the vibration isolation layer, thereby the vibration isolation devices and the elastic member horizon-resetting devices are not interfered with each other, so that positions and functional parameters of the devices can be set and selected reasonably and the various devices are convenient to be maintained.

Modifications of the vibration isolation system of the present invention can be made based on the above.

1) Each moveable base could be divided into an upper portion and a lower portion which are contacted with each other through concave and convex spherical surfaces, and only the upper portion is coupled to the upper beams and/or slabs of the upper layer structure.

2) Unidirectional locking devices are mounted between the upper layer structure and the lower layer structure. Each unidirectional locking device is constructed such that an upper hole is provided in one of the upper beam and/or slab of the upper layer structure, and a lower hole corresponding to the upper hole is provided in the lower layer structure, the upper and lower holes are filled with filling material such as concrete, a stepped hole having a rectangle section is provided in the filling material filled in the upper hole, the stepped hole is divided into two portions, i.e. the upper hole portion and the lower hole portion, the size of the section of the upper hole portion is larger than that of the lower hole portion, thus forming a step therein. A stepped plug, which has a large upper portion and a small lower portion so as to correspond to the stepped hole, passes through the stepped hole and is then fixed at a lower end thereof to the filling material filled in the lower hole.

3) Bi-directional locking devices are mounted between the upper layer structure and the lower layer structure. Each bi-directional locking device is constructed such that an upper hole is provided in one of the upper beam and/or slab of the upper layer structure, and a lower hole corresponding to the upper hole is provided in-the lower layer structure, the upper and lower holes are filled with filling material such as concrete. A plug is fixed at two ends thereof to the filling material filled in the corresponding upper and lower holes respectively.

4) Damping devices are mounted between the upper layer structure and the lower layer structure, each of the damping device is constructed such that an upper hole is provided in the upper beam and/or slab of the upper layer structure, and a lower hole corresponding to the upper hole is provided in the lower layer structure, in which the upper and lower holes are filled with filling material such as concrete, a damping rod is fixed at two ends thereof to a bottom surface of the filling material filled in the upper hole via a coupling plate and an upper surface of the filling material filled in the corresponding lower hole via another coupling plate, respectively.

5) Pulling-resisting devices are provided between the structural members connected to the columns of the building and the fixed bases, each pulling-resisting device is consisted of transversal pulling-resisting beams, vertical pulling-resisting columns and a vibration isolation mechanism. One transversal pulling-resisting beam connects to two vertical pulling-resisting columns so as to form a "∩" shape or a shape similar to the shape of a door, and spans the structural members connected to the column of the building. A vibration isolation mechanism is provided between a bottom surface of the transversal pulling-resisting beam and a top surface of the structural members connected to one column, the two vertical pulling-resisting columns are fixed at their bottom portions to one fixed base respectively. Except for this, the transversal pulling-resisting beam and the vertical pulling-resisting columns are not connected to other members and leave spaces there around.

6) Position-limiting devices are provided between the upper layer structure and the lower layer structure. Particularly, each position-limiting device is constructed such that a lower limit block is provided at the lower layer structure and protruded upwardly, and an upper limit block is provided at the upper beam and/or slab of the upper layer structure and protruded downwardly, in which a space is left between the lower limit block and the upper limit block, and the elevation of the bottom surface of the upper limit block is lower than that of the top surface of the lower limit block.

The vibration isolation devices and pulling-resisting devices which are subjected to a vertical force are provided between the moveable bases and the fixed bases, and the horizon-resetting devices, the locking devices, the damping devices, and the position-limiting devices which are subjected to a horizontal force are arranged between the structural members of the upper layer structure and that of the lower layer structure, thus sufficiently exerting the large rigidity of the structural members of the upper and lower layer structures.

BRIEF DESCRIPTION OF THE DRAWINGS

The embodiments of the present invention is described in detail with reference to the accompanying drawings, like members are denoted by similar reference numerical, in which.

DETAILED DESCRIPTIONS OF THE PREFERRED EMBODIMENTS OF THE PRESENT INVENTION

Now, the preferred embodiments of the present invention are described in detail with reference to the drawings.

Figure 1:
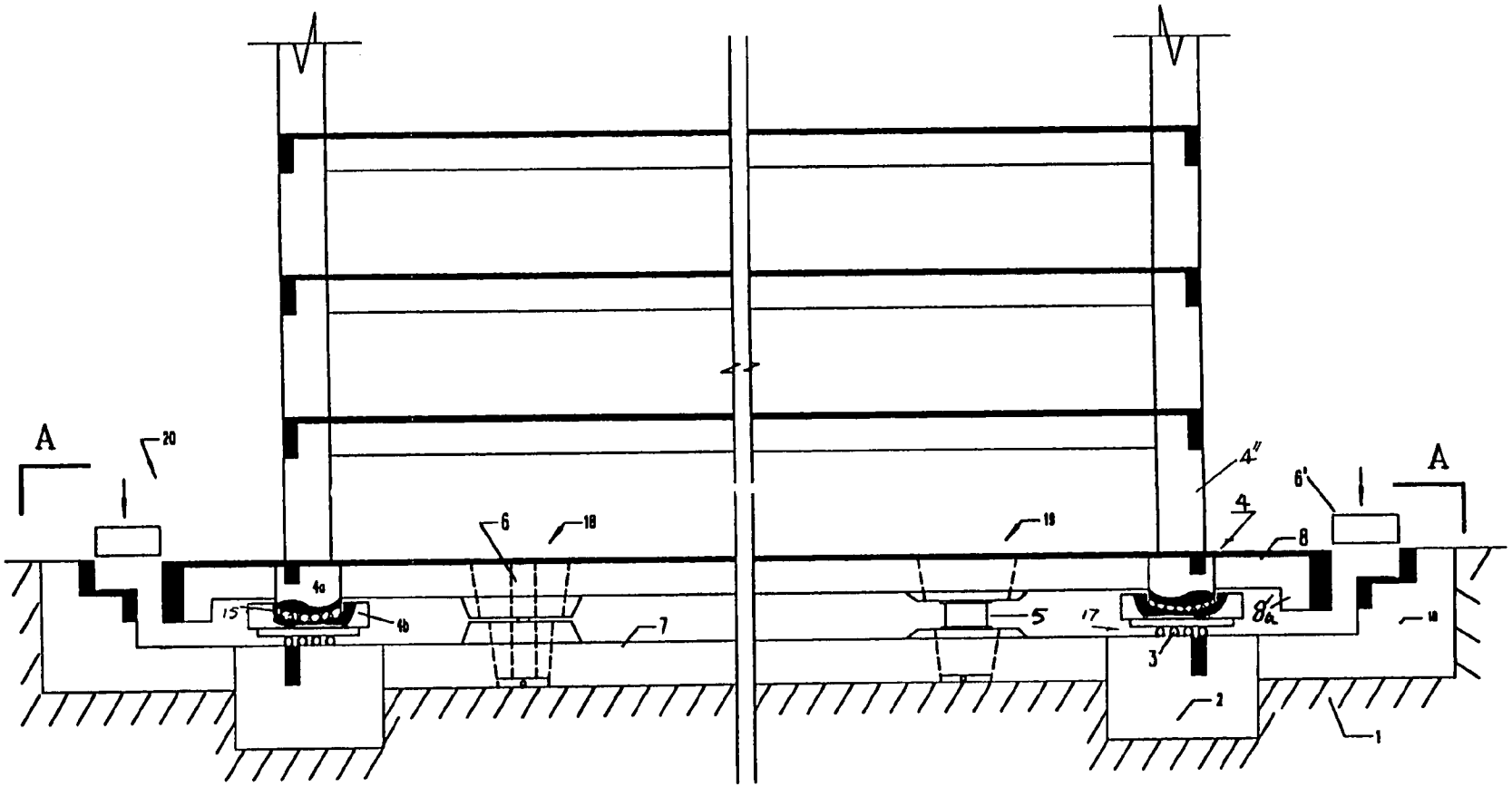
FIG. 1 is a schematic sectional view of the vibration isolation system for building according to an embodiment of the present invention.
Figure 3:
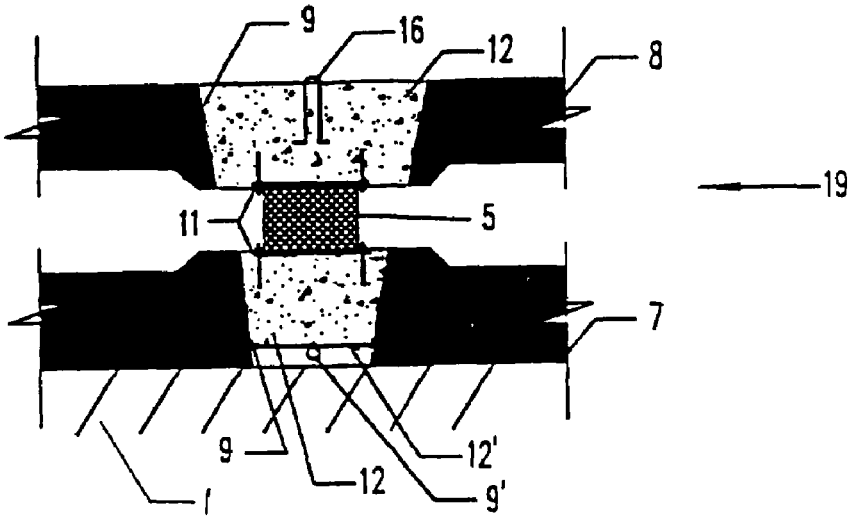
FIG. 3 is a schematic sectional view of a rubber block horizon-resetting device of the vibration isolation system for building according to the embodiment of the present invention.
Figure 4:
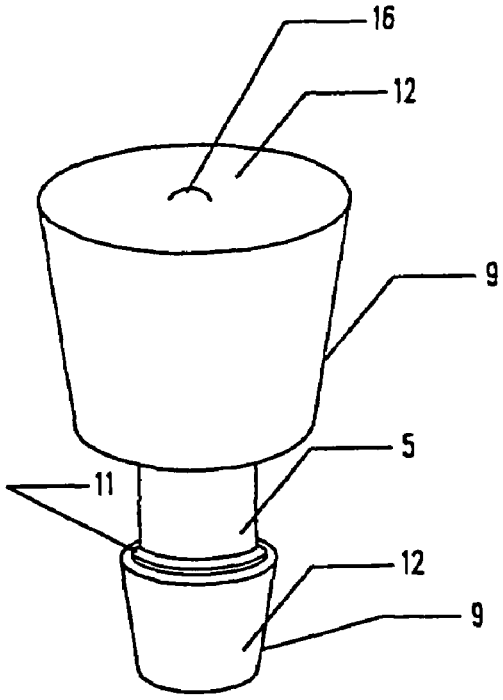
FIG. 4 is a schematic perspective view of the rubber block horizon-resetting device in FIG. 3.
Figure 5:
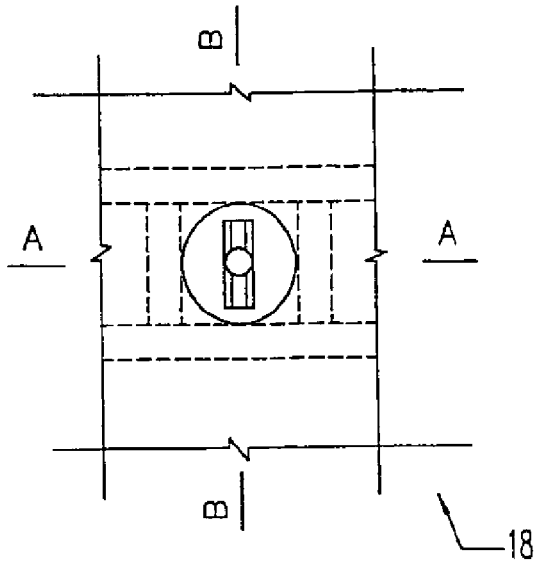
FIG. 5 is a schematic plane of a unidirectional locking device in the form of an exchangeable concrete plug according to the present invention.
Figure 6:
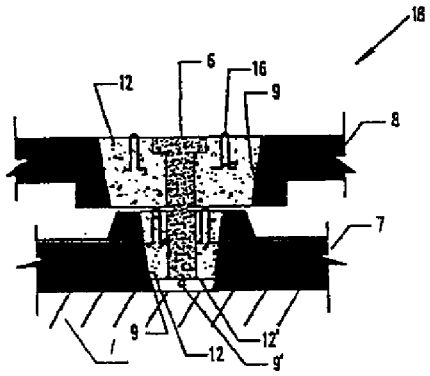
FIG. 6 is a sectional view taken along line A-A in FIG. 5.
Figure 7:
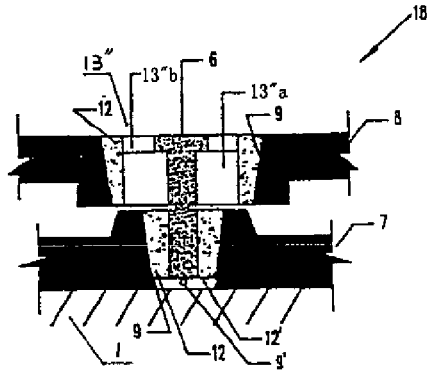
FIG. 7 is a sectional view taken along line B-B in FIG. 5.
Figure 8:
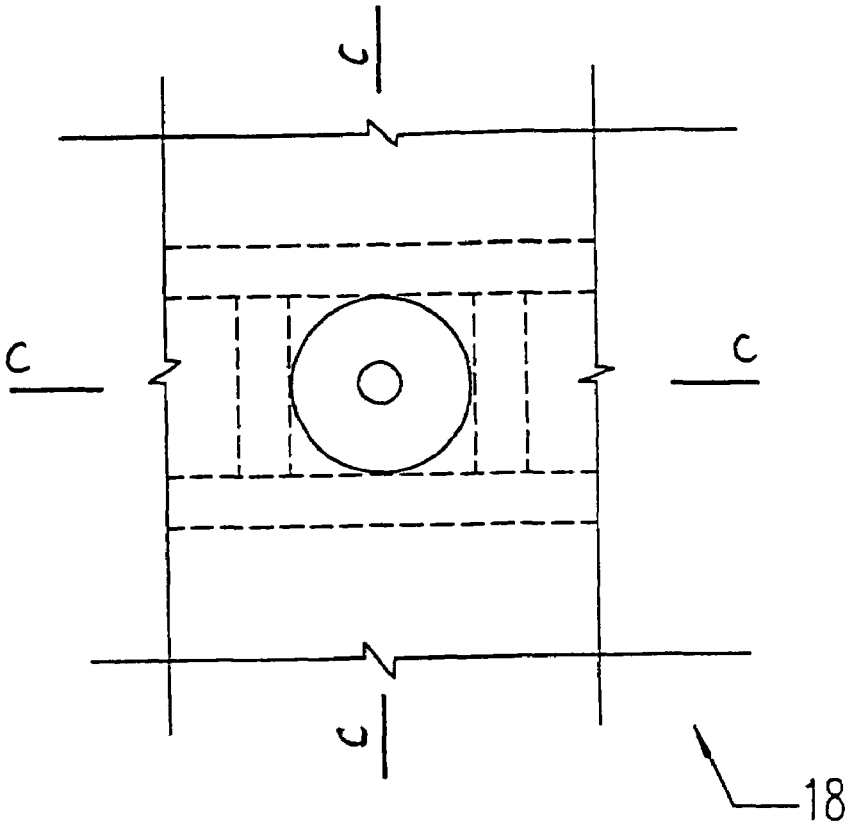
FIG. 8 is a schematic plane of a bi-directional locking device in the form of an exchangeable concrete plug according to the present invention.
Figure 9:
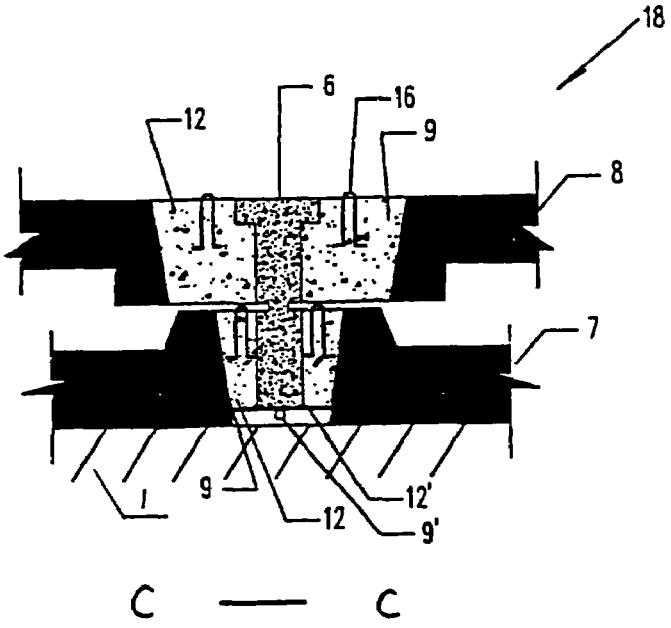
FIG. 9 is a sectional view taken along line C-C in FIG. 8.
Figure 10:
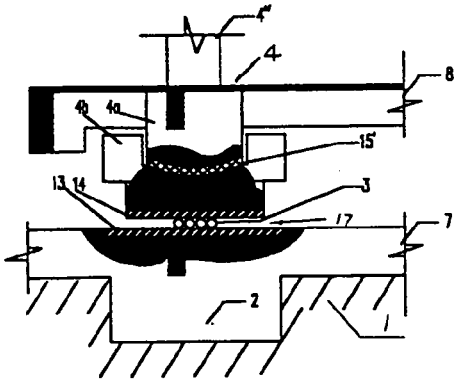
FIG. 10 is a partially enlarged section view of a rolling bearing vibration isolation device according to the present invention.
Figure 13:
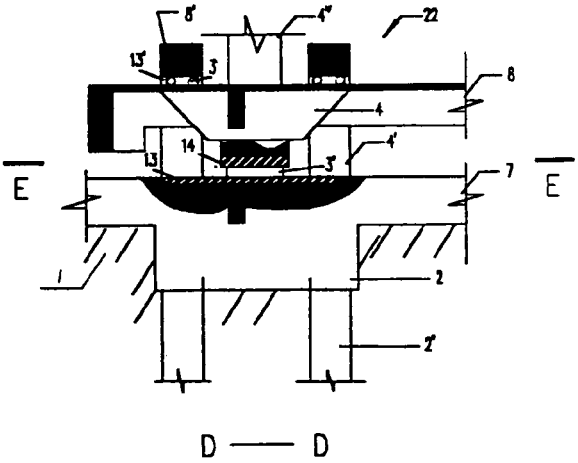
FIG. 13 is a section view taken along line D-D in FIG. 12.
Figure 14:
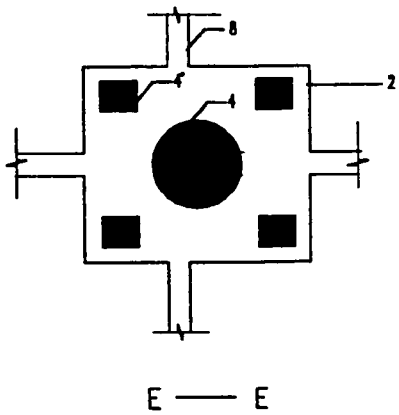
FIG. 14 is a section view taken along line E-E in FIG. 13.

As shown in FIG. 1, a vibration isolation system for building according to an embodiment of the present invention comprises a vibration isolation layer, the vibration isolation layer includes an upper layer structure, a lower layer structure, and various devices of the vibration isolation system which are provided between the upper layer structure and the lower layer structure, the upper layer structure is consisted of upper beams and/or slabs 8 and moveable bases 4, and the lower layer structure is consisted of lower beams and/or slabs 7 and fixed bases 2, the various devices of the vibration isolation system comprises rolling bearing (or sliding bearing) vibration isolation devices 17 and rubber block (or sandwiched rubber block) horizon-resetting devices 19, the rolling bearing vibration isolation devices 17 can be used to raise the base surface and roll balls thereof are exchangeable, the upper layer structure of the vibration isolation layer is coupled with columns 4"; each rolling bearing vibration isolation device 17 (which is consisted of an upper bearing plate 14, a lower bearing plate 13 and roll balls 3, as shown in FIG. 10) is mounted between the corresponding moveable base 4 and the fixed base 2, in the case that the vibration isolation layer comprises sliding bearing vibration isolation devices 17, each sliding bearing vibration isolation device 17 is consisted of an upper bearing plate 14, a lower bearing plate 13 and a sliding block 3', as shown in FIG. 13. Each rubber block (or sandwiched rubber block) horizon-resetting device 19 is mounted between the upper beams and/or slabs 8 of the upper layer structure and the lower beams and/or slabs 7 of the lower layer structure, as shown in FIG. 3 which is a schematic sectional view of one rubber block (or sandwiched rubber block) horizon-resetting device 19 and FIG. 4 which is a schematic perspective view of the rubber block (or sandwiched rubber block) horizon-resetting device 19 in FIG. 3.T*he* upper beams and/or slabs 8 of the upper layer structure are provided with upper holes and the lower beams and/or slabs 7 of the lower layer structure are provided with lower holes corresponding to the upper holes of the upper beam and/or slab 8, the upper holes and the lower holes are filled with concrete (or reinforced concrete) 12, a rubber block 5 having upper and lower coupling plates 11 is mounted between the concrete 12 filled in each upper hole and that filled in each lower hole corresponding to the upper hole, a cementation-preventing material 9 is provided on the walls of the upper and lower holes. An air vent pipe 9' is provided under the concrete 12 filled in each lower hole and used to supplement air so as to prevent the filled concrete 12 from being caught up during hoisting. A lifting ring 16 is provided for maintenance.

Figure 2:
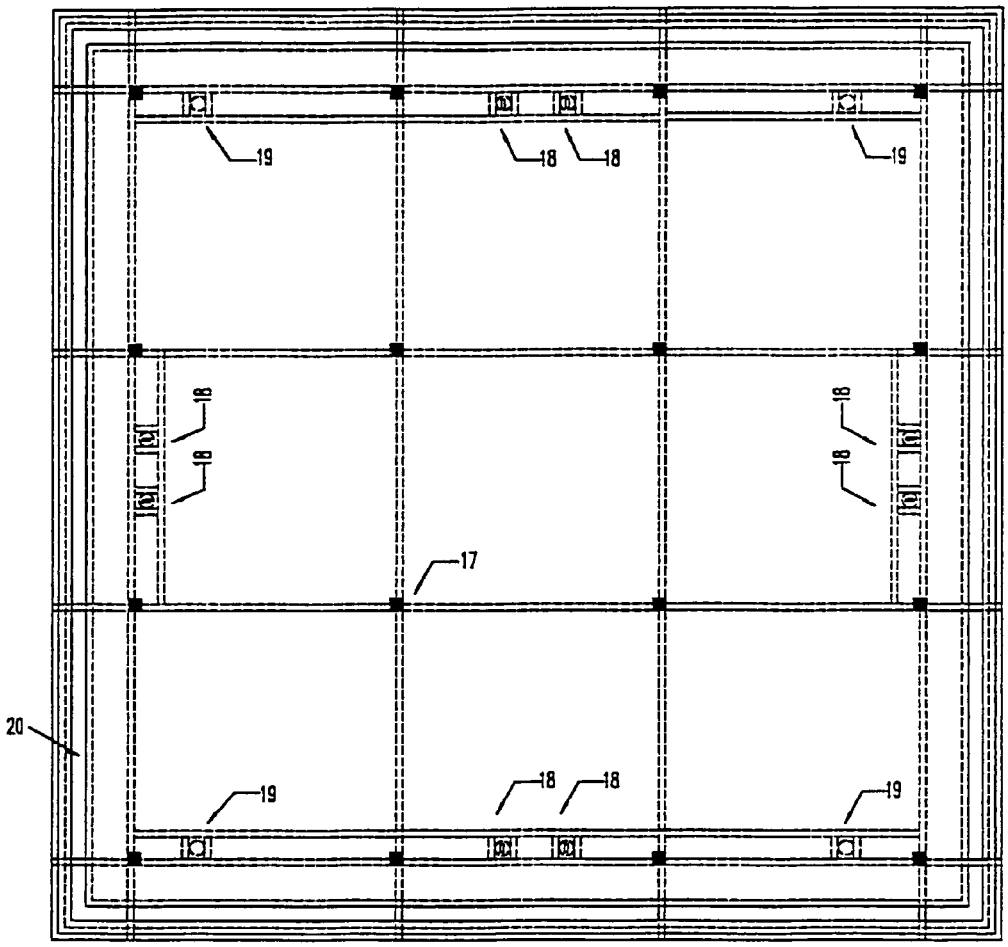
FIG. 2 is a schematic plane view of the upper layer structure of the vibration isolation layer of the vibration isolation system for building according to the embodiment of the present invention.

As shown in FIG. 2, since the rolling bearing vibration isolation devices 17 are mounted between the moveable bases 4 and the fixed bases 2, and the rubber block horizon-resetting devices 19 are mounted between the upper beams and/or slabs 8 of the upper layer structure and the lower beams and/or slabs 7 of the lower layer structure of the vibration isolation layer, thus they are not interfered with each other, so that the functional parameters and positions of the various devices of the vibration isolation system can be designed and selected reasonably. In addition, it is convenient to maintain the various devices. The rolling bearing vibration isolation devices have an additional advantage, that is, even the roll balls are pressed to be broken, the bases can also isolate the vibration from the building in a sliding bearing manner, thus achieving a high safety. Each rubber block horizon-resetting device (which is concurrently used to limit position) is only subjected to a horizontal force, so that the resetting member can be formed of pure rubber, thus is simple to manufacture and low in cost. An enlarged head of a lower portion 4*b* of each moveable base is used to transfer force after mounting a jack.

Next, modifications of the above embodiment are explained as follows.

1) Each moveable base 4 is divided into an upper portion 4*a* and a lower portion 4*b* which are contacted with each other through concave and convex spherical surfaces provided there between. Only the upper portion 4*a* is coupled to the upper beam and/or slab 8 of the upper layer structure; the upper portion 4*a* and the lower portion 4*b* of the moveable base 4 are spherical surface-articulated with each other, thus ensuring no relative angular displacement occurring between the lower bearing plate 13 and the upper bearing plate 14 of the rolling bearing vibration isolation device, so that roll balls 3 bear an even force, thus increasing the load bearing capacity. An elastic liner 15 is provided at a position where the upper portion 4*a* and the lower portion 4*b* are spherical surface-articulated, so as to isolate the vertical vibration, as shown in FIG. 10.

2) Locking devices 18 are provided between the upper layer structure and the lower layer structure. Each locking device 18 comprises a unidirectional locking device or a bi-directional locking device, Each unidirectional locking device is constructed such that an upper hole is provided in the upper beam and/or slab 8 of the upper layer structure and a lower hole corresponding to the upper hole is provided in the lower beam and/or slab 7, the upper and lower holes are filled with concrete (or reinforced concrete) 12, a stepped hole 13" having a rectangle section is provided in the concrete filled in the upper hole, the stepped hole 13" is divided into two portions, i.e. an upper hole portion 13"*a* and a lower hole portion 13"*b*, the upper hole portion 13"*a* and the lower hole portion 13"*b* both have a rectangular section and the size of the section of the upper hole portion 13"*a* is larger than that of the lower hole portion 13"*b*, thus forming a step therein. A concrete (or glass) stepped plug 6, which has a large upper portion and a small lower portion so as to correspond to the stepped hole 13", passes through the stepped hole 13" and is then fixed at a lower end thereof to the concrete 12 filled in the lower hole (a top cap of the concrete stepped plug 6 is seated on the step of the stepped hole 13" so as to prevent the plug 6 from falling subsequently after being sheared, thus achieving a plug effect). The stepped hole 13" having a rectangle section is used to prevent the members of the upper and lower layer structures from generating stretch deformation in a direction parallel to a long edge of the rectangle section when the temperature is changed and the concrete is contracted. If the stretch deformation is generated, a horizontal pressure will be applied to and then destroy the plug 6, thereby the plug 6 will be destroyed and fail. Each unidirectional locking device is arranged at or near a unidirectional immoveable point on each upper layer structure (the unidirectional immoveable point means that a point can only move in one direction on the upper layer structure when the temperature is changed), the long edge of the section of the stepped hole 13" is parallel to the moving direction of the unidirectional immoveable point. The difference between the bi-directional locking device and the unidirectional locking device is in that the concrete 12 of the upper hole is not formed with a hole having rectangular section therein, and one concrete (or glass) plug 6 is fixed at two ends thereof to the concrete 12 filed the upper and lower holes respectively. The plug 6 can usually resist the horizontal load applied to the building. However, for example, when the intensity of the earthquake is equal to or higher than the design intensity that the plug 6 can resist, the plug 6 will be sheared by the earthquake force, thereby the locking device 18 will fail. The plug 6 can be exchanged after earthquake. The locking device 18 can employ a concrete or glass plug, so that it is high in rigidity, low in cost, easy to construct and exchangeable. As shown in FIG. 5 to FIG. 9, when the foundation of the building subsides unevenly, the building may be displaced horizontally, at this time, a plug 6 having higher strength can be substituted to lock the building.

Figure 11:
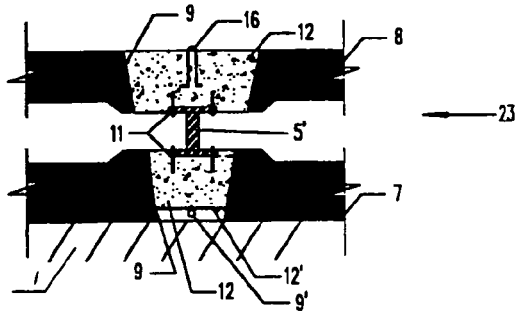
FIG. 11 is a section view of a damping device according to the present invention.

3) As shown in FIG. 11, damping devices 23 are mounted between the upper beams and/or slabs 8 of the upper layer structure and the lower beams and/or slabs 7 of the lower layer structure, the difference between each damping device 23 and the rubber block horizon-resetting device is in that a steel (or lead) rod 5', instead of the rubber block, is connected between the upper and lower coupling plates 11, and the two ends of the steel rod are fixed to a bottom surface of the concrete 12 filled in the upper hole and a top surface of the concrete 12 filled in the lower hole via the coupling plates 11, respectively. When the earthquake occurs, the relative displacement between the members of the upper layer structure and that of the lower layer structure of the vibration isolation layer causes the steel rod 5' to convert the kinetic energy into thermal energy.

Figure 12:
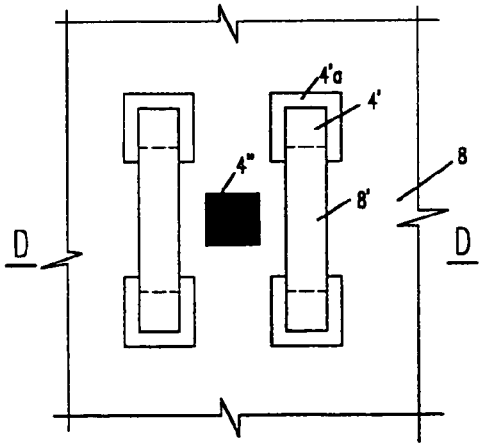
FIG. 12 is a plane view of a pulling-resisting device comprising a rolling bearing mechanism according to the present invention, in which each base of the building employs a rolling bearing vibration isolation device.

4) As shown in FIG. 12, pulling-resisting devices 22 are provided between the moveable bases 4 and the fixed bases 2, each pulling-resisting device 22 is consisted of transversal pulling-resisting beams 8', vertical pulling-resisting columns 4' and rolling bearing (or sliding bearing) vibration isolation mechanism 13', in which construction of the rolling bearing (or sliding bearing) vibration isolation mechanism 13' is substantially identical with that of the rolling bearing (or sliding bearing) vibration isolation device. Each transversal pulling-resisting beam 8' and two vertical pulling-resisting columns 4' form a door which spans the moveable base 4 (or structural member beams 8" coupled to a column 4, as shown in FIG. 16). A rolling bearing vibration isolation mechanism 13' is provided between a bottom surface of the transversal pulling-resisting beam 8' and a top surface of the moveable base 4, the two vertical pulling-resisting columns 4' are fixed at their bottom portions to the fixed base 2 respectively. A pulling-resisting pile 2' is connected to the fixed base 2 and the foundation 1. Except for this, the transversal pulling-resisting beam 8' and the vertical pulling-resisting columns 4' are not connected to other members and leave spaces there around (in FIG. 12 and FIG. 15, the space formed between the vertical pulling-resisting column 4' and the upper layer structure is indicate by the reference numerical "4'*a*), so that the transversal pulling-resisting beam 8' and the vertical pulling-resisting columns 4' are prevented from colliding with other members when earthquake occurs. The pulling force of the column 4" is transferred to the moveable base 4, and then to the transversal pulling-resisting beam 8' via the vibration isolation mechanism 13', sequentially, the pulling force of the column 4" is transferred to the vertical pulling-resisting columns 4' from the transversal pulling-resisting beam 8', then to fixed base 2, and finally to the pulling-resisting pile 2' and foundation 1.

Figure 15:
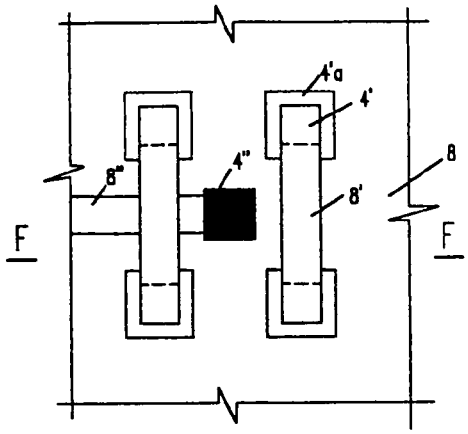
FIG. 15 is a plane view of a sliding bearing mechanism pulling-resisting device according to the present invention, in which each base of the building employs a sliding bearing vibration isolation device.
Figure 16:
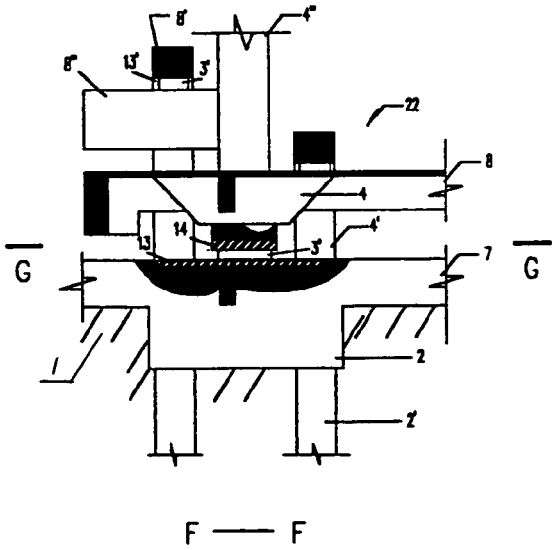
FIG. 16 is a section view taken along line F-F in FIG. 15.
Figure 17:
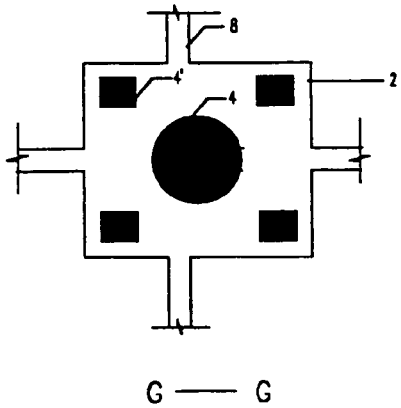
FIG. 17 is a section view taken along line G-G in FIG. 16.

Except that the moveable base 4 is replaced by the beam 8" coupled to column 4" and the roll ball 3 of the rolling bearing vibration isolation mechanism is replaced by a sliding plate 3' of the sliding bearing vibration isolation mechanism, the example shown in FIG. 15 is substantially identical with that shown in FIG. 12.

5) As shown in FIG. 1, position-limiting devices 20 are provided between the upper layer structure and the lower layer structure. More specifically, each position-limiting devices 20 is constructed such that a lower limit block 10 is provided at the lower beam and/or slab 7 of the lower layer structure and protruded upwardly, and an upper limit block 8'*a* is provided at the upper beam and/or slab 8 of the upper layer structure and protruded downwardly, in which a space is left between the lower limit block 10 and the upper limit block 8'*a,* and the elevation of the top surface of the lower limit block 10 is higher than that of the bottom surface of the upper limit block 8'*a.* In case that the earthquake of high intensity occurs, when the relative displacement between the upper and lower layer structure is over large, the upper limit block 8'*a* is collided with the lower limit block 10 so as to limit the above displacement. The position-limiting device 20 can prevent the relative displacement of the building from being over large, thus achieving the position limiting function through collision. A jack is disposed between the upper limit block 8'*a* and the lower limit block 10 so as to eliminate the residual offsetting between the moveable base and the fixed base.

The vertical load of the upper structure of the building is sequentially transferred, via the columns 4", to the upper portion 4*a* and the lower portion 4*b* of each moveable base 4, the rolling bearing vibration isolation device 17, the fixed base 2, and finally to the foundation 1. When the intensity of the earthquake is lower than the design intensity that the locking devices of vibration isolation system can resist or the vibration is not resulted from the earthquake, a part of the horizontal load of the building is sequentially transferred to the upper beams and/or slabs 8 of the upper layer structure via the upper portion 4*a* from the columns 4", then to the locking devices 18, to fixed bases 2 via the lower beams and/or slabs 7 of the lower layer structure, and finally to the foundation 1. The other part of the horizontal load is sequentially transferred to the rolling bearing vibration isolation devices 17 and then to the fixed bases 2 via the upper portion 4*a* and the lower portion 4*b* of each moveable base 4, and finally to the foundation 1. When the foundation 1 subsides unevenly, especially inclines integrally, an over large relative displacement of the building resulted from the subsiding or inclination can be prevented by inserting concrete blocks 6' of high strength between side surfaces of the upper limit blocks 8'*a* and the lower limit blocks 10 of the position-limiting devices 20 in time. On the other hand, when the intensity of the earthquake is equal to or higher than the design intensity that the locking devices can resist, the horizontal vibration force exceeds the ultimate bearing capacity of the plugs 6 (which is determined during design) of the locking devices, the plug 6 is sheared, so that the locking devices 18 will fail to transfer the force, at this time, the horizontal load resulted from the earthquake is only transferred by the rubber blocks 5 of the resetting devices 19 and the roll balls 3 of the vibration isolation devices 17 as they are moved along with the ground, such transferred load resulted from the earthquake is very small, so that there are less disadvantageous influence on the safety of the building.

As shown in FIG. 13 and FIG. 16, between the moveable bases and fixed bases are provided sliding bearing vibration isolation devices, bearing plates 13 and 14, and sliding blocks 3'.

Although a few preferred embodiments of the present invention have been shown and described, it would be appreciated by those skilled in the art that changes may be made in these embodiments without departing from the principles and spirit of the present invention, the scope of which is defined by the claims and their equivalents.

What is claimed is:

1. A vibration isolation system for building, comprising a vibration isolation layer, the vibration isolation layer including:

an upper layer structure consisted of upper beams or slabs and moveable bases, which is coupled to columns of the building;

a lower layer structure consisted of lower beams or slabs and fixed bases; and vibration isolation devices and elastic member horizon-resetting devices which are mounted between the upper layer structure and the lower layer structure, wherein:

the vibration isolation devices are mounted between the moveable bases and the fixed bases, respectively;

the elastic member horizon-resetting devices are mounted between the beams or slabs of the upper layer structure and the lower layer structure, respectively and each elastic member horizon-resetting device is constructed such that an upper hole is provided in the upper beam or slab of the upper layer structure and a lower hole corresponding to the upper hole is provided in the lower beam or slab of the lower layer structure, in which the corresponding upper and lower holes are filled with filling material, and an elastic member having an upper coupling plate and a lower coupling plate is mounted between the filling material filled in the upper hole and that filled in the corresponding lower hole.

2. The vibration isolation system for building according to the claim 1, wherein each moveable base is divided into an upper portion and a lower portion which are contacted with each other through concave and convex spherical surfaces provided there between, and only the upper portion is coupled to the upper beams or slabs of the upper layer structure.

3. The vibration isolation system for building according to the claim 1, wherein locking devices are mounted between the upper layer structure and the lower layer structure.

4. The vibration isolation system for building according to the claim 3, wherein the locking devices comprise unidirectional locking devices, and each unidirectional locking device is constructed such that an upper hole is provided in the upper beam or slab of the upper layer structure, and a lower hole corresponding to the upper hole is provided in the lower layer structure, in which the upper and lower holes are filled with filling material, and a stepped hole having a rectangle section and divided into an upper hole portion and a lower hole portion is provided in the filling material filled in the upper hole, the size of the section of the upper hole portion is larger than that of the lower hole portion, thus forming a step therein, and a stepped plug having a large upper portion and a small lower portion so as to correspond to the stepped hole passes through the stepped hole formed in the filling material of the upper hole and is then fixed at a lower end thereof to the filling material filled in the lower hole, while an upper end of the stepped plug is positioned in the stepped hole.

5. The vibration isolation system for building according to the claim 3, wherein the locking devices comprise bi-directional locking devices, and each bi-directional locking device is constructed such that an upper hole is provided in the upper beam or slab of the upper layer structure and a lower hole corresponding to the upper hole is provided in the lower layer structure, in which the upper and lower holes are filled with filling material respectively, and a plug is fixed at two ends thereof to the filling material filled in the upper hole and the lower hole respectively.

6. The vibration isolation system for building according to the claim 1, wherein damping devices are mounted between the upper layer structure and the lower layer structure, each of the damping device is constructed such that an upper hole is provided in the upper beam and/or slab of the upper layer structure and a lower hole corresponding to the upper hole is provided in the beam or slab of the lower layer structure, in which the upper and lower holes are filled with filling material respectively, and a damping rod is fixed at two ends thereof to a bottom surface of the filling material filled in the upper hole via a coupling plate and an upper surface of the filling material filled in the lower hole via another coupling plate, respectively.

7. The vibration isolation system for building according to the claim 1, wherein pulling-resisting devices are provided between the structural member beams connected to the columns of the building and the fixed bases, each pulling-resisting device is consisted of transversal pulling-resisting beams, vertical pulling-resisting columns and a vibration isolation mechanism, in which one transversal pulling-resisting beam connects to two vertical pulling-resisting columns so as to form a "∩" shape which spans a structural member beam connected to one column of the building, and a vibration isolation mechanism is provided between a bottom surface of the transversal pulling-resisting beam and a top surface of the structural member beam connected to one column of the building, the two vertical pulling-resisting columns are fixed at their bottom portions to the fixed base respectively, except for this, the transversal pulling-resisting beams and the vertical pulling-resisting columns are not connected to other structural members and leave spaces there around.

8. The vibration isolation system for building according to the claim 1, wherein position-limiting devices are provided between the upper layer structure and the lower layer structure, each position-limiting device is constructed such that a lower limit block is provided at the lower beam or slab of the lower layer structure and protruded upwardly, and an upper limit block is provided at the upper beam or slab of the upper layer structure and protruded downwardly, in which a space is left between the lower limit block and the upper limit block, and the elevation of the boffom surface of the upper limit block is lower than that of the top surface of the lower limit block.

* * * * *